US006509310B1

(12) United States Patent
Huish et al.

(10) Patent No.: US 6,509,310 B1
(45) Date of Patent: Jan. 21, 2003

(54) COMPOSITIONS CONTAINING α-SULFOFATTY ACID ESTERS AND METHOD OF MAKING THE SAME

(75) Inventors: Paul Danton Huish, Salt Lake City, UT (US); Laurie A. Jensen, Midvale, UT (US); Pule B. Libe, Salt Lake City, UT (US); Mark J. Fredrickson, Salt Lake City, UT (US)

(73) Assignee: Huish Detergents, Inc., Salt Lake City, UT (US)

( * ) Notice: Subject to any disclaimer, the term of this patent is extended or adjusted under 35 U.S.C. 154(b) by 0 days.

(21) Appl. No.: 09/585,684

(22) Filed: Jun. 1, 2000

(51) Int. Cl.[7] ..... C11D 17/50

(52) U.S. Cl. ..... 510/446; 510/447; 510/450; 510/357; 510/428

(58) Field of Search ..... 510/440, 446, 510/450, 447, 428, 357, 383, 426, 422, 4.25; 560/147

(56) References Cited

U.S. PATENT DOCUMENTS

| | | | |
|---|---|---|---|
| 3,962,107 | A | 6/1976 | Levin et al. |
| 3,997,576 | A | 12/1976 | Oghoshi et al. |
| 4,064,062 | A | 12/1977 | Yurko |
| 4,219,435 | A | 8/1980 | Biard et al. |
| 4,438,025 | A | 3/1984 | Satsuki et al. |
| 5,133,892 | A | 7/1992 | Chun et al. |
| 5,213,705 | A | 5/1993 | Olson |
| 5,225,100 | A | 7/1993 | Fry et al. |
| 5,382,677 | A | 1/1995 | Colignon et al. |
| 5,391,783 | A | 2/1995 | Colignon et al. |
| 5,397,494 | A | 3/1995 | Vega |
| 5,429,773 | A | 7/1995 | Sherry et al. |
| 5,475,134 | A | 12/1995 | Baker |
| 5,616,781 | A | 4/1997 | Sajic et al. |
| 5,637,560 | A | 6/1997 | Raehse et al. |
| 5,688,982 | A | 11/1997 | Khan |
| 5,783,540 | A | 7/1998 | Secemski et al. |
| 5,900,399 | A | 5/1999 | Seiter et al. |
| 5,945,394 | A | 8/1999 | Sajic et al. |
| 5,961,662 | A | 10/1999 | Yamaguchi et al. |
| 5,972,861 | A | 10/1999 | Rolfes |
| 5,980,580 | A | 11/1999 | Yamaguchi et al. |
| 6,057,280 | A | 5/2000 | Huish et al. |

OTHER PUBLICATIONS

Foster, Norman C., Hovda, Keith D., "Manufacture of Methyl Ester Sulfonates and Other Derivaties", CHEMITHON, 1997.

Hovda, Keith, "The Challenge of Methylester Sulfonation", CHEMITHON, 1997, Seattle, Washington, NMA.

MacArthur, Brian W., Brooks, Burt, Sheats, Brad W., Foster, Norman C., Ph.D., P.E., "Meeting the Challenge of Methylester Sulfonation", CHEMITHON, 1998, Seattle, Washington, NMA.

Foster, Norman C., Ph.D., P.E., "Sulfonation and Sulfation Processes", CHEMITHON, 1997, Seattle, Washington, NMA.

Hovda, Keith, "Methyl Ester Sulfonation: Process Optimization", CHEMITHON, Seattle, Washington, 1997, NMA.

Foster, Norman C., Ph.D., P.E., Rollock, Michael, BS ChE., "Medium to Very High Active Single Step Neutralization", CHEMITHON, Seattle, Washington, 1997, NMA.

"Surfactants", Inform, Vol. 7, No. 1 (Jan. 1996), pp. 10–12, 1997, NMA.

Rao, Y.K., Sajic, B., "Physico–Chemical Properties of Some Salts of Sulfo Methyl Ester Surfactants", 1996, 4$^{th}$ World Surfacftants Congress, pp. 382–391, NMA.

*Primary Examiner*—Necholus Ogden
(74) *Attorney, Agent, or Firm*—Townsend and Townsend and Crew LLP

(57) ABSTRACT

Compositions and methods for a composition comprising at least one α-sulfofatty acid ester in a first portion and at least one basic material in a second, different portion. After preparing the first and second portions separately, the first and second portions are joined to form a final composition. The first and second portions are joined together to form the final composition in a manner to minimize contact, thereby reducing the formation of additional di-salts, and thereby improving the properties of the composition.

23 Claims, No Drawings

COMPOSITIONS CONTAINING α-SULFOFATTY ACID ESTERS AND METHOD OF MAKING THE SAME

BACKGROUND OF THE INVENTION

The present invention generally relates to compositions. Specifically, the present invention relates to compositions containing c-sulfofatty acid esters and methods of making and using the same.

Detergent compositions have been known and used as cleaning agents for many years. (See, e.g., U.S. Pat. Nos. 5,783,540; 5,482,641; 5,397,494; 5,358,655; 5,324,649; 5,133,892; 4,913,832; 4,828,749; 4,828,745; 4,588,080; 4,569,780; 4,518,516; 4,219,435; Re. 32,763; and Re. 32,818; the disclosures of which are incorporated herein by reference.) Surfactants are included in detergents due to their excellent surface-activity characteristics. Typical surfactants include anionic, nonionic and cationic surfactants, those described in Surface Active Agents, Volumes I and II by Schwartz, Perry and Berch (New York, Interscience Publishers), Nonionic Surfactants ed. by M. J. Schick (New York, M. Dekker, 1967), and in McCutcheon's Emulsifiers & Detergents (1989 Annual, M. C. Publishing Co.), the disclosures of which are incorporated herein by reference. Such surfactants are used singly or in combination, according to the desired properties of the resulting composition.

Recently, a-sulfofatty acid esters (also referred to hereafter as "sulfofatty acids") have gained attention due to the improved cleaning performance of these surfactants. (See, e.g., U.S. Pat. Nos. 5,616,781; 5,637,758; 5,681,803; 5,945,394; and 6,057,280, the disclosures of which are incorporated herein by reference.) α-Sulfofatty acid esters are typically manufactured as sulfofatty acid salts, which also exhibit surface active agent properties. α-Sulfofatty acid ester salts are usually formed as a mixture of salt forms, such as mono- and di-salts. For example, sodium methyl ester sulfonate ("sMES") can be a mixture of mono-sodium MES ("msMES") and di-sodium MES ("dsMES"). While mono-salts of α-sulfofatty acid esters have the desired surface active agent properties, di-salts have several undesirable properties that degrade the performance of the α-sulfofatty acid ester. For example, the Kraft point of a $C_{16}$ methyl ester sulfonate di-salt is 65° C., as compared to 17° C. for the mono-salt form of $C_{16}$ MES. (The Kraft point is the temperature below which surfactants form precipitates instead of micelles; at the Kraft point, the solubility of an ionic surfactant is equal to its critical micelle concentration.) Di-salts also increase the sensitivity of the surfactants to hard water. The resulting poor di-salt solubility in cool and even slightly hard water is a disadvantage in most applications. Generally, significant amounts of di-salt in otherwise high quality α-sulfofatty acid ester degrade the performance of the α-sulfofatty acid ester.

Mono-salts of α-sulfofatty acid esters are unstable and react with basic substances, in the presence of moisture, to form di-salts. For example, msMES reacts with caustic soda (NaOH) in the presence of water to form a di-salt by the following chemical reaction:

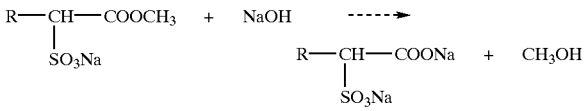

Basic materials in detergents also react in a similar manner to form di-salts. Because the formation of di-salts degrades the performance of the α-sulfofatty acid ester, more mono-salt must be added to the composition to provide the same level of surface active agent performance. Such supplementation increases the cost and unit size of the detergent. Accordingly, there is a need for α-sulfofatty acid ester-containing compositions that reduce additional di-salt formation by the α-sulfofatty acid esters, and for methods for making and using such compositions.

SUMMARY OF THE INVENTION

The present invention provides compositions, and methods for making and using such compositions, containing at least one α-sulfofatty acid ester in a first (ester) portion and at least one basic material in a second (basic) portion. These separate portions are combined to form a composition, according to the present invention. The portions are joined to minimize contact between the α-sulfofatty acid ester and basic materials, thereby reducing formation of additional di-salts.

In one embodiment, the composition comprises a first portion containing at least one α-sulfofatty acid ester and a second portion containing at least one basic material, with minimal contact between the sulfofatty acid and the basic material. The α-sulfofatty acid ester is typically a sodium methyl ester sulfonate. The basic material is a compound that causes hydrolysis of α-sulfofatty acid ester by directly interacting with the α-sulfofatty acid ester or by causing a change to higher (basic) pH values, which causes the α-sulfofatty acid ester to hydrolyze. Such basic materials generally include zeolites, phosphates, silicates, carbonates, caustic soda, borate salts, and the like.

Contact between the (α-sulfofatty acid ester in a first portion and the basic material in the second portion is minimized by an intermediate portion between the first and second portions, by a boundary layer at the interface of the first and/or second portions, by minimizing the surface area of the interface between the portions, and/or adjusting the concentration of the α-sulfofatty acid ester and/or basic material in the first and/or second portions, respectively.

The invention also provides methods for making compositions by providing a first portion containing at least one α-sulfofatty acid ester, providing a second portion containing at least one basic material, and joining first and second portions while minimizing contact between the α-sulfofatty acid ester and the basic material. The α-sulfofafty acid ester can be a sodium methyl ester sulfonate. Such basic materials generally include zeolites, phosphates, silicates, carbonates, caustic soda, borate salts, and the like. Contact between the α-sulfofatty acid ester and the basic material can be minimized by providing an intermediate portion between the first and second portions, by providing a boundary layer at the interface of the first and/or second portions, by forming the detergent composition in a shape minimizing physical contact between the portions, and/or by adjusting the concentration of the α-sulfofatty acid ester and/or the basic material in the first and/or second portions, respectively.

DETAILED DESCRIPTION OF THE INVENTION

The following description provides specific details, such as dimensions and materials, to provide a thorough understanding of the present invention. The skilled artisan will understand, however, that the present invention can be practiced without employing these specific details. Indeed, the present invention can be practiced in conjunction with fabrication techniques conventionally used in the detergent industry. Moreover, the processes below describe only steps, rather than a complete process flow, for manufacturing detergent compositions.

A preferred embodiment according to the present invention comprises at least two portions. The first portion comprises at least one α-sulfofatty acid ester, and the second portion comprises at least one basic material. The composition is formed joining the first and second portions while minimizing contact between the α-sulfofatty acid ester and the basic material.

The First (Ester) Portion

In a preferred embodiment, the first portion comprises at least one α-sulfofatty acid ester. Suitable α-sulfofatty acid esters include linear or branched esters of a carboxylic acid (e.g., a fatty acid) that is sulfonated. The α-sulfofatty acid ester also includes those described in U.S. Pat. No. 5,945,394, the disclosure of which is incorporated herein by reference.

The α-sulfofatty acid ester is typically of the following formula (I):

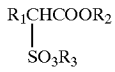

(I)

where $R_1$ is a linear or branched alkyl group, $R_2$ is a linear or branched alkyl group, and $R_3$ is hydrogen, a halogen, a mono-valent or di-valent cation, a metal, or an unsubstituted or substituted ammonium cation. $R_1$ can be a $C_4$ to $C_{24}$ alkyl group including a $C_{10}$, $C_{12}$, $C_{14}$, $C_{16}$, and/or $C_{18}$ alkyl group. $R_2$ can be a $C_1$ to $C_8$ alkyl group, including a methyl group. $R_3$ is typically a mono-valent or di-valent cation that forms a water soluble salt with the (α-sulfofatty acid ester, including an alkali metal such as sodium, potassium or lithium. The α-sulfofatty acid ester of formula (I) is typically a methyl ester sulfonate, such as a $C_{16}$ methyl ester sulfonate, a $C_{18}$ methyl ester sulfonate, or a mixture thereof.

More typically, the α-sulfofatty acid ester is a salt of the following formula (II):

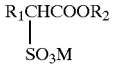

(II)

where $R_1$ and $R_2$ are linear alkanes and M is a monovalent metal. For example, $R_1$ can be an alkane containing 6 to 22 carbon atoms, and is typically a $C_{10}$, $C_{12}$, $C_{14}$, $C_{16}$ and/or $C_{18}$ alkane. $R_2$ is typically an alkyl group containing 1 to 8 carbon atoms, and more typically a methyl group. M is an alkali metal, typically sodium.

The α-sulfofatty acid ester of formula (II) is typically a sodium salt of methyl ester sulfonate, such as a $C_{16}$ sodium methyl ester sulfonate, a $C_{18}$ sodium methyl ester sulfonate, or a mixture thereof.

The α-sulfofatty acid esters of formulae (I) and (II) can be manufactured by any suitable method known in the art. Suitable methods of manufacturing include those described in, for example, U.S. Pat. Nos. 5,329,030; 5,382,677; 5,384,422; 4,816,188; and 4,671,900; International patent publication WO-91/09009; and The Journal of American Oil Chemists Society 52:323–29 (1975); the disclosures of which are incorporated herein by reference. Such α-sulfofatty acid esters can also be manufactured using a variety of sources, including but not limited to beef tallow, palm kernel oil, palm stearine oil, coconut oil, soybean oil, canola oil, cohune oil, palm oil, white grease, cottonseed oil, and mixtures or fractions thereof. Other sources of fatty acids are caprylic ($C_8$), capric ($C_{10}$), lauric ($C_{12}$), myristic ($C_{14}$), myristoleic ($C_{14}$), palmitic ($C_{16}$), palmitoleic ($C_{16}$), stearic ($C_{18}$), oleic ($C_{18}$), linoleic ($C_{18}$), linolenic ($C_{18}$), ricinoleic ($C_{18}$), arachidic ($C_{20}$), gadolic ($C_{20}$), behenic ($C_{22}$), and erucic ($C_{22}$) fatty acids. In an embodiment, the α-sulfofatty acid ester is a mixture of different chain lengths from one or more of these sources.

In another embodiment, the α-sulfofatty acid ester is a $C_{12}$, $C_{14}$, $C_{16}$, or $C_{18}$ α-sulfofatty acid ester. Alternatively, the ester portion comprises a mixture of αsulfofatty acid esters. Such mixtures are selected according to the properties of the α-sulfofatty acid esters. For example, $C_{16}$ and $C_{18}$ sulfofatty acids (e.g., from tallow and/or palm stearin) generally provide better surface active agent properties, but are less soluble in aqueous solutions. $C_{12}$ and $C_{14}$ α-sulfofatty acid esters (e.g., from palm kernel and/or coconut) are more soluble in water, but have lesser surface active agent properties. Suitable mixtures of α-sulfofatty acid ester include, for example, about 1 to about 99 weight percent of a $C_{16}$ or $C_{18}$ α-sulfofatty acid ester and about 99 to about 1 weight percent of a $C_{16}$, or $C_{18}$ α-sulfofatty acid ester. Other suitable mixtures include $C_{12}$ and/or $C_{14}$ sulfofatty acid combined with $C_{16}$ and/or $C_{18}$ sulfofatty acid. For example, about 1 to about 99 percent of $C_{12}$ and/or $C_{14}$ sulfofatty acid is combined with about 99 to about 1 weight percent of $C_{16}$ and/or $C_{18}$ sulfofatty acid. About 10–20 weight percent $C_{12}$ and/or $C_{14}$ sulfofatty acid can also be combined with about 90–80 weight percent $C_{16}$ and/or $C_{18}$ sulfofatty acid. In another embodiment, the α-sulfofatty acid ester 15 is a mixture of $C_{18}$ methyl ester sulfonate and a $C_{16}$ methyl ester sulfonate and having a ratio of about 2:1 to about 1:3. Other mixtures of sulfofatty acids are also within the scope of the present invention, as will be appreciated by the skilled artisan.

In another embodiment, the ester portion is enriched for particular α-sulfofatty acid ester(s), as disclosed in co-pending U.S. patent application Ser. No. 09/574,996 (Attorney Docket No. 04193.009/1335), filed May 19, 2000, to provide the desired surfactant properties. The disclosure of that application is incorporated by reference herein. For example, sulfofatty acids made from palm stearine, palm kernel, or beef tallow oils can be enriched for $C_{16}$ α-sulfofatty acid esters.

The total amount of α-sulfofatty acid ester in the first portion can also vary, depending on the desired properties of the first portion and the composition. In an embodiment, the first portion comprises about 1 to about 100 weight percent α-sulfofatty acid ester—and typically about 50 weight percent to about 100 weight percent—with the balance being by-products of the process used to manufacture the sulfofatty acid. The first portion can include some di-salt which is formed during the manufacturing process.

In another embodiment, the first portion includes additional components. Suitable components include those detergent components known in the art. Such components include, for example, non-basic salts, other anionic surfactants, nonionic surfactants, cationic surfactants, zwitterionic surfactants, sodium borate, monomers and polymers such as acrylic and polyacrylic acids, fragrances, foam regulators, binders, dyes, water, fillers, optical brighteners, oxidizing agents, biocidal agents, enzymes, thickeners, stabilizers, fragrances, soil suspending agents, polymeric soil release agents, fillers, water, inert ingredients, disintegrants (which draw moisture in and allow the portion to dissolve) such as cellulose, and mixtures or combinations thereof. The amounts of such additional components in the first portion can range from 0 weight percent to about 50 weight percent or more, depending on the desired characteristics of the final composition.

In another embodiment, the first portion is substantially free of basic materials that cause more than a minor amount of additional di-salt formation. A "minor amount" means less than about 30 weight percent, typically less than about 15 weight percent, and more typically less than about 7 weight percent additional di-salt formation. Preferably, such components cause less than about 1% additional di-salt formation. The preceding ranges apply to additional di-salt formation and exclude di-salt already present in the α-sulfofafty acid ester as a result of the manufacturing process. The method of George Battaglini et al, *Analytical Methods for Alpha Sulfo Methyl Tallowate*, JOACS, Vol. 63, No. 8 (August 1986), the disclosure of which is incorporated herein by reference, can be used to determine whether a component causes additional di-salt in an α-sulfofatty acid ester sample, as compared with a control sample.

Suitable salts include sodium chloride and sodium carbonate. Suitable additional anionic surfactants include dodecyl hydrogen phosphate, alkylbenzenesulfonates, alkyl or alkenyl sulfates, alkyl or alkenyl ether sulfates, substituted sulfonates such as methyl naphthalene sulfonate and sodium 2-acetamido-hexadecane-1-sulfonate, sodium dodecylbenzene $C_{10}$–$C_{16}$ sulfonate, alkyl or alkenyl ether sulfate, alkyl or alkenyl sulfates, alkane sulfonates, olefin sulfonates, alkyl or alkenyl ether carboxylates, amino acid-type surfactants, N-acyl amino acid-type surfactants, and those listed in U.S. Pat. No. 5,783,540, the disclosure of which is incorporated herein by reference.

Suitable nonionic surfactants include those which contain an organic hydrophobic group and a hydrophilic group that is a reaction product of a solubilizing group (such as carboxylate, hydroxyl, amido or amino) with ethylene oxide or propylene oxide or with a polyhydration product thereof, such as polyethylene glycol. Such nonionic surfactants include polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkanolamides, polyoxyalkylene fatty acid alkanolamides, alkylglucosamides, alkylglucosides, and alkylamine oxides. Other suitable surfactants include those listed in U.S. Pat. Nos. 5,133,892; 5,358,655; 5,783,540; and 4,219,435; the disclosures of which are incorporated herein by reference.

Suitable polymers include maleic acid polymers, acrylic acid polymers or copolymers or salts thereof, ethylene maleic anhydride cross-linked copolymer, polyethylene glycol, polyvinyl pyrrolidone, or a salt thereof, carboxymethylcellulose, polyvinylalcohol, and cellulose ether.

Suitable enzymes include any of those known in the art, such as amylolytic, proteolytic or lipolytic type, and those listed in U.S. Pat. No. 5,324,649, the disclosure of which is incorporated herein by reference. One preferred protease, sold under the trademark SAVINASE® by NOVO Nordisk Industries A/S, is a subtillase from *Bacillus lentus*. Other suitable enzymes include proteases, amylases, lipases, and cellulases, such as ALCALASE® (bacterial protease), EVERLASE® (protein-engineered variant of SAVINASE®), ESPERASE® (bacterial protease), LIPOLASE® (fungal lipase), LIPOLASE ULTRA (protein-engineered variant of LIPOLASE), LIPOPRIME™ (protein-engineered variant of LIPOLASE), TERMAMYL® (bacterial amylase), BAN (Bacterial Amylase Novo), CELLUZYME® (fungal enzyme), and CAREZYME® (monocomponent cellulase), sold by Novo Industries A/S.

Suitable foam regulators include chemical compounds with a hydrophobe/hydrophile balance suitable to reducing the stability of protein foam. The hydrophobicity can be provided by an oleophilic portion of the molecule (e.g., an aromatic alkyl or aralkyl group, an oxypropylene unit or oxypropylene chain, or other oxyalkylene functional groups other than oxyethylene such as tetramethylene oxide). The hydrophilicity can be provided by oxyethylene units or chains or blocks and/or ester groups (e.g., organophosphate esters), salt-type groups, or salt-forming groups. Other suitable foam regulators include silicone materials, alkyl phosphate esters such as monostearyl phosphate, and microcrystalline waxes.

Suitable binders, which help hold the ingredients of the portions together while allowing dissolution in the wash water, include starches, starch derivatives, celluloses, cellulose derivatives, pyrrolidone derivatives, polymethacrylates, polyvinyl alcohols, polyethylene glycols, monoglycerides, glyceryl stearates and glycerides.

The first portion can further include suitable dyes, fragrances, and/or fillers. Solvents, such as water, can also be included in the first portion. Water can be added as a separate ingredient or in combination with one of the other detergent components.

The second portion contains at least one basic material. A basic material is a compound which causes hydrolysis of α-sulfofatty acid ester mono-salts to di-salts. Basic materials cause hydrolysis by directly interacting with α-sulfofatty acid ester mono-salts or by causing a change to a higher (basic) pH value. Basic materials can be identified according to the method of George Battaglini et al, *Analytical Methods for Alpha Sulfo Methyl Tallowate*, JOACS Vol. 63, No. 8 (August 1986), the disclosure of which is incorporated herein by reference. Typical basic materials include, but are not limited to, alkali metal ortho-, pyro- and tripolyphosphates and hexametaphosphates, anhydrous and hydrated silicates, carbonates, zeolites, caustic soda and borate salts. Typical zeolites include zeolite A, NaA, Nax, P, Y, 4A and MAP. In some embodiments, zeolites, sodium silicate, sodium carbonate, caustic soda, sodium tripolyphosphate or a mixture thereof are include in the second portion. The amount of basic material in the second portion can range from about 1 weight percent to 100 weight percent and typically about 50 weight percent to about 99 weight percent.

Other components can be added to the second portion. Such components include any of the detergent components described above. The amount of such components in the second portion can range from about 0 weight percent to 99 weight percent, and typically from about 1 weight percent to about 50 weight percent, depending on the desired characteristics of the second portion and final composition.

Other suitable detergent components include oxidizing agents (e.g., non-chlorine oxidizing agents) include oxygen bleaches such as perborates, percarbonates, persulfates, dipersulfates, sodium carbonate peroxyhydrate, urea peroxyhydrate, other peroxyhydrates, and sodium peroxide. Other suitable non-chlorine oxidizing agents include bleach activators, such as tetraacetyl ethylene diamine (TAED), sodium benzoyl oxybenzene sulfonate, choline sulfophenyl carbonate, and those described in U.S. Pat. Nos. 4,915,854 and 4,412,934, the disclosures of which are incorporated herein by reference. Other suitable non-chlorine oxidizing agents include a catalyst such as manganese or other transition metal in combination with such oxygen bleaches. Other suitable oxidizing agents include percarboxylic acid bleaching agents and salts thereof, such as magnesium monoperoxyphthalate hexahydrate and the magnesium salts of meta-chloro perbenzoic acid, 4-nonylamino-4-oxoperoxybutyric acid and diperoxydodecanedioic acid, Other oxidizing agents include those described in U.S. Pat. Nos. 4,483,781; 4,634,551; and 4,412,934; and European Patent Application No. 0,133,354, the disclosures of which are incorporated herein by reference. Other suitable oxidizing agents include non-oxygen containing oxidizing agents, such as photoactivated bleaching agents. Suitable photoactivated bleaching agents include sulfonated zinc and metal phthalocyanines like aluminum and zinc phthalocyanines. Other suitable photoactivated bleaching agents are described in U.S. Pat. No. 4,033,718, the disclosure of which is incorporated herein by reference.

Suitable biocidal agents include TAED, TAED combined with a persalt, triclosan, and quaternary ammonium compounds such as alkyl dimethyl ammonium chlorides, alkyl trimethyl ammonium chlorides, dialkyl dimethyl ammonium chlorides, benzalkonium chloride, and alkyl dimethyl benzyl ammonium chloride. Other biocidal agents include those sold under the trade names BARDAC® (quaternary ammonium compounds, dialkyl dimethyl ammonium chlorides) and BARQUAT® (quaternary ammonium compounds, alkyl dimethyl benzyl ammonium chlorides) by the Lonza Group and those sold under the trademark BTC® (dimethyl ammonium chlorides) by the Stepan Company.

Suitable optical brighteners include stilbenes such as TINOPAL® AMS, distyrylbiphenyl derivatives such as TINOPAL® CBS-X, , stilbene/naphthotriazole blends such as TINOPAL® RA-16, all sold by Ciba Geigy, oxazole derivatives, and coumarin brighteners.

The first and second portions together form a final composition, according to the present invention. The first and second portions are formed and then joined to minimize contact between the α-sulfofatty acid ester in the first portion and the basic material in the second portion. In one embodiment, when the first and second portions are joined, the α-sulfofatty acid ester in the first portion does not contact the basic material in the second portion. In another embodiment, the first and second portions are joined such that the contact between the portions reduces, but does not completely prevent contact of the a-sulfofatty acid ester(s) by the basic material(s).

The relative proportions of the first and second portions depend on the intended use and desired properties of the final composition. When greater surfactant properties are desired for the final composition, the amount of the first portion is greater relative to the second portion. Alternatively, the amount of the second portion is larger than the first portion. The final composition can contain from about 1 weight percent to about 99 weight percent of the first portion and from about 99 weight percent to about 1 weight percent of the second portion. Typically, the composition contains from about 10 weight percent to about 70 weight percent of the first portion and from about 30 weight percent to about 90 weight percent of the second portion.

Contact between the first and second portions typically inhibits—and in some embodiments prevents—the hydrolysis of α-sulfofatty acid ester by the basic material. Contact can be minimized by either physical or chemical separation. In one preferred embodiment, contact is minimized so that only a negligible amount (less than about one weight percent) additional di-salt results from hydrolysis of the α-sulfofatty acid ester by the basic material. In another embodiment, when the first and second portions are joined, less than a minor amount of additional di-salt is formed. (See supra) In one embodiment, contact between the first and second portions is minimized by an intermediate portion (e.g., a layer) between the first and second portions. The intermediate portion is composed of any suitable material that protects the α-sulfofatty acid ester in the first portion from additional di-salt formation. Suitable materials for the intermediate portion include inorganic salts such as non-basic salts (e.g., NaCl, $Na_2SO_4$), vinyl polymers such as polyvinyl alcohol, partially or fully hydrolyzed polyvinyl alcohol, polyvinyl acetate, polyvinyl pyrrolidone, or polyvinyl-methylmethacrylate copolymer, maleic acid/acrylic acid copolymers or salts thereof, ethylene/maleic anhydride copolymers, polyethylene glycol, acrylic acid polymer, carboxymethyl cellulose, cellulose ether, paraffin waxes, fatty acids, α-sulfofatty acid esters (e.g., methyl ester sulfonates), di-salts of α-sulfofatty acid esters, soaps, waxes, other water-soluble polymers, other water-swellable polymers, copolymers or mixtures thereof. The shape and thickness of the intermediate portion can vary, depending on the material used and the degree of protection desired.

In another embodiment, contact between the first and second portions is minimized by adjusting the concentration of the α-sulfofatty acid ester and/or basic material in the respective portions. The detergent components listed above can be used to adjust the concentration of the sulfofatty acid and/or basic material. For example, by diluting the α-sulfofatty acid ester and/or basic material, less material (i.e., α-sulfofatty acid ester and/or basic material) is present at the contact between the first and second portions, leading to less additional di-salt formation. In one embodiment, suitable salts for adjusting the concentration of the α-sulfofatty acid ester include sodium chloride and sodium sulfate. For example, such salts can be combined with $C_{12}$, $C_{14}$, $C_{16}$, and/or $C_{18}$ α-sulfofatty acid ester in the first portion, and in amounts ranging from about 1 to about 35 weight percent salt and about 99 to about 65 weight percent α-sulfofatty acid ester. In another embodiment, di-salts of α-sulfofatty acid esters are included in the first and/or second portions as a diluent.

In another embodiment, contact between the α-sulfofatty acid ester and the basic material is minimized by providing a boundary layer (or boundary portion) in the first and/or second portion. The boundary layer can be provided at any interface between the first and second portions. A suitable boundary layer can be formed from a low concentration of α-sulfofatty acid ester or basic material, or any of the materials described above. The shape and thickness of the boundary layer can vary depending on the material used and the degree of protection desired.

In another embodiment, contact between the α-sulfofatty acid ester and the basic material is minimized by controlling the shape of the portions. When the first and second portions are joined together, the first and second portions are configured so that the surface area between the portions is minimized. Accordingly, shapes providing the lesser amounts of physical contact, such as tablets in the form of spheres, ellipsoids, cylinders, cubes, polyhedrons (e.g. hexahedrons and tetrahedrons), and the like, can be used.

In still another embodiment, contact between the α-sulfofatty acid ester of the first portion and the basic material of the second portion is minimized by a combination of any of the embodiments described above. For example, the first and second portions are formed as an ellipsoid with an intermediate portion provided therebetween.

The composition comprising the first and second portions can be of any suitable size and weight, depending on its intended use. For example, a composition, in the form of a tablet, can have dimensions of about 36 mm in length, about 27 mm in width, and about 15 mm in depth, and a weight of about 10 to about 50 grams.

The first and second portions are formed in any suitable manner known in the art. In one embodiment, the first and second portions are manufactured separately and then joined together to form a composition according to the present invention. The first portion can be manufactured by any suitable process known in the art. For example, the first portion is manufactured by sulfonating a source of methyl ester in a film type reactor using gaseous sulfur trioxide, neutralizing the sulfonation product using a base such as sodium hydroxide, mixing the resulting α-sulfofatty acid ester with any additional desired components, and then drying, extruding, and cooling the mixture to form pieces. Such pieces can include granules, pellets, beads, a powder, and the like. Those pieces can then be formed into a first portion of any suitable shape. Alternatively, the first portion is formed by agglomeration, dry blending, or fluid bed mixing α-sulfofatty acid ester with one or more other components and then forming the mixture into a first portion.

The second portion is formed by combining at least one basic material, and any other desired components, to form granules, pellets, beads, a powder, and the like. The basic material and other components can be mixed by spray drying, agglomeration, fluid bed mixing, and the like.

In one method, the first and second portions are added to a mold (e.g., a die) and then compacted. In another method, the first (or second) portion is partially compacted, mixed with the second (or first) portion, and then compacted again. In still another method, the first and/or second portions are joined by encapsulation. Suitable methods of encapsulation include using an intermediate portion to separate the first and second portions. For example, the α-sulfofatty acid ester and/or basic material is encapsulated by coating or by providing a boundary portion about the surface of the first and/or second portion. In any of the methods described above, an intermediate layer can be applied between the first and second portions prior to compaction.

In another embodiment, the first and second portions are joined to make a composition using the following procedure. First, material comprising the first portion (or second portion) is placed in a suitable pressing machine to make a first layer. Next, the pressing machine partially compresses the first portion. Then, material comprising the second portion (or first portion) is placed in the pressing machine adjacent (e.g., over) the compressed portion. Then, the pressing machine joins the compressed first portion and uncompressed second portion into a composition with the desired shape. Suitable pressing machines include tablet presses from Korsch, such as a KORSCH EK-II Tablet Press, a KORSCH TRP700 Technical Rotary Press, or Scheu & Kniss Sentry press. Typically, about 2–3 tons of pressure is applied to form the tablets, although greater or lesser amounts can be used.

The present invention can be illustrated by the following examples. These examples illustrate principles of the present invention and are not intended to limit the scope of the invention.

EXAMPLES

In the following examples, all percentages are given as weight percentages, unless otherwise indicated. The ratio of di-salt to mono-salt is calculated as:

$$\frac{\text{amount of di-salt formed} - \text{original di-salt content}}{\text{total amount of active material (mono-salt and di-salt)}}$$

and referred to as the "% di-salt/active."

Example 1

At least one α-sulfofatty acid ester is formed into a first portion. At least one basic material, such as active spray dried base, is formed into a second portion. The portions are combined to form tablets or pills. Active spray dried base contains the following:

| Ingredient | Weight Percent |
|---|---|
| Water | 3% |
| Sodium LAS | 12% |
| Sodium Silicate, solids | 4.55% |
| Sodium Sulfate | 1.2% |
| Na CMC | 1.0% |
| Optical Brightener | 0.1% |
| Sodium Carbonate | Balance |

Example 2

Sodium methyl ester sulfonate ("sMES") was manufactured from beef tallow methyl ester in a film type reactor using gaseous sulfur trioxide. The reaction product was neutralized using sodium hydroxide, dried, extruded, cooled on a chilled belt and allowed to solidify into pieces. The solidified sMES was then ground into a powder and mixed with the components in the following proportions and compressed to prepare detergent tablet A.

| Detergent Tablet A | Weight Percent |
|---|---|
| MES | 35.0% |
| Active Spray Dried Base | 62.7% |
| Sodium Perborate Mono | 1.0% |
| Savinase 6.0 T | 1.0% |
| Fragrance | 0.10% |
| Blue Specks | 0.20% |

Example 3 sMES was prepared as in Example 2 and then mixed with varying detergent components, as indicated in Table 1, to make nine uncompressed first portions. Nine second (basic) portions were prepared with the proportions indicated in Table 1. The basic portions, each as an uncompressed form, were then placed adjacent the uncompressed first portions in the tablet press. The tablet press then compressed the first portion and basic portion together to form rectangular detergent tablets B through J. The tablets weighed between about 25–35 grams. About 2.5 tons of pressure was used to form the tablets.

TABLE 1

| | B | C | D | E | F | G | H | I | J |
|---|---|---|---|---|---|---|---|---|---|
| First (Ester) Portion | | | | | | | | | |
| sMES | 35 | 35 | 35 | 35 | 35 | 35 | 35 | 35 | 35 |
| Sodium Sulfate | 0 | 0 | 20 | 0 | 0 | 20 | 0 | 0 | 20 |
| NaCl | 0 | 20 | 0 | 0 | 20 | 0 | 0 | 20 | 0 |
| Subtotal First Portion | 35 | 55 | 55 | 35 | 55 | 55 | 35 | 55 | 55 |
| Second (Basic) Portion | | | | | | | | | |
| 12% LAS (spray dried) | 0 | 0 | 0 | 60.6 | 40.6 | 40.6 | 0 | 0 | 0 |
| Sodium Perborate Monohydrate | 1 | 1 | 1 | 1 | 1 | 1 | 1 | 1 | 1 |
| Savinase 6.0 T | 1 | 1 | 1 | 1 | 1 | 1 | 1 | 1 | 1 |
| Spray Dried without active | 0 | 0 | 0 | 0 | 0 | 0 | 60.6 | 40.6 | 40.6 |
| Silicated Soda Ash | 60.6 | 40.6 | 40.6 | 0 | 0 | 0 | 0 | 0 | 0 |
| Fragrance | 0.2 | 0.2 | 0.2 | 0.2 | 0.2 | 0.2 | 0.2 | 0.2 | 0.2 |
| Sodium Stearate | 0.2 | 0.2 | 0.2 | 0.2 | 0.2 | 0.2 | 0.2 | 0.2 | 0.2 |
| Blue Specks | 2.0 | 2.0 | 2.0 | 2.0 | 2.0 | 2.0 | 2.0 | 2.0 | 2.0 |
| Subtotal Basic Portion | 65 | 45 | 45 | 65 | 45 | 45 | 65 | 45 | 45 |

Spray dried base without active contains:

| | |
|---|---|
| Water | 2% |
| Sodium Chloride | 10 |
| Alcosperse 412 as is | 10 |
| Optical Brightener | 0.20 |
| Sodium Carbonate | Balance |

Example 4

Samples of tablets A through J were aged in a humidity chamber with a relative humidity of 80% and temperature of 103° Fahrenheit. At each time point, one tablet was removed and tested for additional di-salt formation. The di-salt formed is stated as %di-salt active over time (as days elapsed from day of manufacture) and reported in Table 2.

TABLE 2

| Days | A | B | C | D | E | F | G | H | I | J |
|---|---|---|---|---|---|---|---|---|---|---|
| 0 | 0 | 0 | 0 | 0 | 0 | 0 | 0 | 0 | 0 | 0 |
| 15 | 11.5 | 4.98 | 6.39 | 5.31 | 6.15 | 2.28 | 7.23 | 6.76 | 6.24 | 5.74 |
| 22 | 13.14 | 3.4 | 3.47 | 5.33 | 4.42 | 3.07 | 5.56 | 5.86 | 5.76 | 4.39 |
| 29 | 21.34 | 7.24 | 6.91 | 3.87 | 6.74 | 7.54 | 7.61 | 6.43 | 6.50 | 6.33 |
| 36 | 21.5 | 5.36 | 6.07 | 4.46 | 7.02 | 5.78 | 5.97 | 4.57 | 8.03 | 4.51 |
| 76 | 36.64 | 7.67 | 9.40 | 7.07 | 12.65 | 5.38 | 4.92 | 6.47 | 7.98 | 6.54 |

As seen from Table 2, by comparing di-salt formation in Tablet A (which has α-sulfofatty acid ester mixed with basic materials) with that in Tablets B-J, separating the sMES from the basic material minimized the amount of additional di-salt formed.

Having described in detail the present invention above, the invention defined by the appended claims is not limited by such details, as many apparent variations are possible without departing from the scope or spirit thereof.

We claim:

1. A tablet detergent composition, comprising:

a first portion comprising at least one methyl ester sulfonate, the first portion substantially free of basic materials that cause more than a minor amount of additional disalt formation; and a second portion joined to the first portion, the second portion comprising at least one basic material;

with minimal contact between the methyl ester sulfonate and the at least one basic material, wherein additional disalt formation by the methyl ester sulfonate is reduced.

2. The composition of claim 1, wherein the methyl ester sulfonate is at least one ester of the formula:

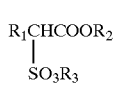

(I)

wherein $R_1$ is an alkane, $R_2$ is methyl, and $R_3$ is hydrogen, a halogen, a mono-valent cation, a di-valent cation, an unsubstituted or substituted ammonium cation, or a metal.

3. The composition of claim 2, wherein $R_1$ is a $C_4$ to $C_{24}$ alkane, $R_2$ is methyl, and $R_3$ is hydrogen, a mono-valent cation, an unsubstituted or substituted ammonium cation, or a metal.

4. The composition of claim 3, wherein $R_1$ is a $C_{10}$, $C_{12}$, $C_{14}$, $C_{16}$, or $C_{18}$ alkane, or mixture thereof, $R_2$ is a methyl group, and M is an alkali metal.

5. The composition of claim 1, wherein the at least one basic material is a zeolite, sodium tripolyphosphate, sodium silicate, sodium carbonate, caustic soda, a borate salt, or a mixture thereof.

6. The composition of claim 1, wherein the minimal contact allows less than a minor amount of additional di-salt formation.

7. The composition of claim 1, wherein an intermediate portion located between the first and second portions provides the minimal contact.

8. The composition of claim 1, wherein a boundary portion provides the minimal contact.

9. The composition of claim 1, wherein the shape of the composition provides the minimal contact.

10. The composition of claim 9, having a substantially cuboidal, ellipsoidal, spherical, or polyhedral shape.

11. The composition of claim 1, wherein the first or second portions further comprise at least one detergent component.

12. The composition of claim 11, wherein the additional detergent component dilutes the concentration of the methyl ester sulfonate or the basic material.

13. A tablet detergent composition, comprising:

a first portion comprising at least one α-sulfofatty acid ester of formula (I):

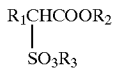

(I)

wherein $R_1$ is an alkane, $R_2$ is methyl, and $R_3$ is hydrogen, a halogen, a metal, or an unsubstituted or substituted ammonium cation, the first portion free of basic materials that cause more than a minor amount of additional disalt formation; and a second portion joined to the first portion, the second portion comprising at least one basic material;

with minimal contact between the cc-sulfofatty acid ester and the basic material to prevent more than a minor amount of additional di-salt formation.

14. The detergent composition of claim 13, wherein the basic material is a zeolite, sodium silicate, sodium carbonate, caustic soda, sodium tri-polyphoshate, a borate salt, or a mixture thereof.

15. The detergent composition of claim 13, wherein the minimal contacts prevents more than about 7 weight percent additional di-salt salt formation by the α-sulfofatty acid ester.

16. A method for making a tablet detergent composition, comprising:

providing a first portion comprising at least one α-sulfofatty acid ester comprising methyl ester sulfonate, the first portion substantially free of basic materials that cause more than a minor amount of additional disalt formation;

providing a second portion comprising at least one basic material; and joining the first and second portions while minimizing contact between the sulfofatty acid and the basic material, whereby less than a minor amount of additional disalt formation occurs.

17. The method of claim 16, the basic material comprising a zeolite, sodium silicate, sodium carbonate, caustic soda, sodium tripolyphosphate, a borate salt, or a mixture thereof.

18. The method of claim 16, further comprising:

providing an intermediate portion between the first and second portions to minimize the contact therebetween.

19. The method of claim 16, further comprising:

providing a boundary layer in the first or second portion to minimize the contact between the α-sulfofatty acid ester and the basic material.

20. The method of claim 16, further comprising:

providing the composition in a shape which minimizes the contact.

21. The method of claim 20, wherein the composition is a tablet having a substantially rectangular shape.

22. The method of claim 16, further comprising:

at least one additional detergent component.

23. The method of claim 22, the additional detergent component diluting the sulfofatty acid or the basic material to minimize the contact.

* * * * *

UNITED STATES PATENT AND TRADEMARK OFFICE

CERTIFICATE OF CORRECTION

PATENT NO. : 6,509,310 B1 
DATED : January 21, 2003
INVENTOR(S) : Paul Danton Huish et al.

It is certified that error appears in the above-identified patent and that said Letters Patent is hereby corrected as shown below:

Column 13,
Line 35, after "with minimal contact between the", please delete "cc" and insert -- α --.

Column 14,
Line 3, after "di-salt", please delete "salt".

Signed and Sealed this

Twentieth Day of May, 2003

JAMES E. ROGAN
*Director of the United States Patent and Trademark Office*